US009617103B2

(12) United States Patent
Higuchi et al.

(10) Patent No.: US 9,617,103 B2
(45) Date of Patent: Apr. 11, 2017

(54) SHEET MANUFACTURING APPARATUS

(71) Applicant: SEIKO EPSON CORPORATION, Tokyo (JP)

(72) Inventors: Naotaka Higuchi, Fujimi-machi (JP); Shigeo Fujita, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/635,092

(22) Filed: Mar. 2, 2015

(65) Prior Publication Data

US 2015/0251867 A1 Sep. 10, 2015

(30) Foreign Application Priority Data

Mar. 7, 2014 (JP) ..... 2014-044765

(51) Int. Cl.
*B65H 20/10* (2006.01)
*D01G 25/00* (2006.01)

(52) U.S. Cl.
CPC ... *B65H 20/10* (2013.01); *B65H 2301/44735* (2013.01); *B65H 2406/3223* (2013.01); *D01G 25/00* (2013.01)

(58) Field of Classification Search
CPC ..... B65H 20/10; B65H 2301/44734; B65H 2301/44735; B65H 2406/30; B65H 2406/31; B65H 2406/32; B65H 2406/322; B65H 2406/3221; B65H 2406/3223; B65H 2406/323; B65H 2406/361; B65H 2406/3124; B21F 1/523; B21F 1/526
See application file for complete search history.

(56) References Cited

U.S. PATENT DOCUMENTS

| | | | | |
|---|---|---|---|---|
| 3,765,971 | A | 10/1973 | Fleissner | |
| 4,142,661 | A * | 3/1979 | Nettles | B65H 23/24 242/615.11 |
| 4,366,025 | A | 12/1982 | Gordon, Jr. et al. | |
| 4,417,931 | A | 11/1983 | Li | |
| 4,668,322 | A | 5/1987 | Christensen | |
| 4,809,404 | A | 3/1989 | Lasenga | |
| 5,414,902 | A | 5/1995 | Kroyer | |

(Continued)

FOREIGN PATENT DOCUMENTS

| | | | |
|---|---|---|---|
| CN | 104894904 | A | 9/2015 |
| JP | 2006-525435 | A | 11/2006 |

*Primary Examiner* — Michael McCullough
(74) *Attorney, Agent, or Firm* — Global IP Counselors, LLP

(57) ABSTRACT

A sheet manufacturing apparatus includes: a first transport unit that causes a first transport belt to circle around so as to transport a web; and a second transport unit that is disposed with a part thereof shifted from the first transport unit toward the downstream side in a transport direction of the web, sucks the web in a direction in which the web is spaced from the first transport belt, and transports the web. The second transport unit includes a suction chamber which is positioned on an inner side of a second transport belt circling around and of which an inner space is sucked by a suction unit such that the web is adsorbed onto the second transport belt. The suction unit is positioned on the outer side of the second transport belt in a direction orthogonal to the transport direction of the web along the surface of the web.

8 Claims, 4 Drawing Sheets

(56) References Cited

U.S. PATENT DOCUMENTS

| | | | | |
|---|---|---|---|---|
| 5,730,440 | A * | 3/1998 | Motooka | B65H 5/224 271/197 |
| 5,741,402 | A | 4/1998 | Trokhan et al. | |
| 6,141,833 | A | 11/2000 | Sorensen | |
| 6,375,773 | B1 | 4/2002 | Andersen | |
| 7,331,089 | B2 | 2/2008 | Christensen | |
| 7,942,406 | B2 * | 5/2011 | Ootaki | B65H 35/04 271/197 |
| 8,763,219 | B2 | 7/2014 | Jonsson et al. | |
| 9,328,461 | B2 | 5/2016 | Fujita et al. | |
| 2002/0168910 | A1 | 11/2002 | Vuillaume et al. | |
| 2003/0217448 | A1 * | 11/2003 | Andersen | B32B 5/26 28/104 |
| 2005/0091811 | A1 | 5/2005 | Billgren et al. | |
| 2005/0148261 | A1 | 7/2005 | Close et al. | |
| 2014/0027075 | A1 | 1/2014 | Yamagami et al. | |
| 2014/0374047 | A1 | 12/2014 | Yamagami | |
| 2015/0096701 | A1 | 4/2015 | Higuchi et al. | |
| 2015/0096702 | A1 | 4/2015 | Higuchi et al. | |
| 2015/0096703 | A1 | 4/2015 | Fujita et al. | |
| 2015/0096705 | A1 | 4/2015 | Fujita et al. | |
| 2015/0238062 | A1 | 8/2015 | Baker et al. | |
| 2015/0240417 | A1 | 8/2015 | Higuchi | |
| 2015/0251867 | A1 | 9/2015 | Higuchi et al. | |
| 2015/0252530 | A1 | 9/2015 | Higuchi et al. | |
| 2015/0275429 | A1 | 10/2015 | Higuchi et al. | |
| 2015/0275430 | A1 | 10/2015 | Higuchi et al. | |

* cited by examiner

SHEET MANUFACTURING APPARATUS

BACKGROUND

1. Technical Field

The present invention relates to a sheet manufacturing apparatus.

2. Related Art

JP-T-2006-525435 discloses that a suction box is provided in an enclosure of a transfer wire of an apparatus for forming, in a dry way, a cloth material formed of two sheets of nonwoven fabric.

In the apparatus disclosed in JP-T-2006-525435, since a space is needed, in which a suction unit (suction box) is provided in a transfer wire, the transfer wire has to be lengthy and thus, the apparatus is increased in size.

SUMMARY

The invention can be realized in the following forms or application examples.

(1) According to an aspect of the invention, a sheet manufacturing apparatus that forms a sheet using a web includes: an accumulation unit that accumulates a web containing at least a fiber on a first transport belt; a first transport unit that causes the first transport belt to circle around so as to transport the web; and a second transport unit that is spaced from the first transport unit in a direction perpendicular to a surface of the web, is disposed with a part thereof shifted from the first transport unit toward the downstream side in a transport direction of the web, and sucks the web in a direction in which the web is spaced from the first transport belt and transports the web. The second transport unit includes a suction unit that generates a suction force, a second transport belt that circles around, and a suction chamber which is positioned in an inner side of the second transport belt circling around and of which an inner space is sucked by the suction unit such that the web is adsorbed onto the second transport belt. The suction unit is positioned on the outer side of the second transport belt in a direction orthogonal to the transport direction of the web along the surface of the web.

In the sheet manufacturing apparatus, the suction unit is not provided on the inner side of the second transport belt but is provided on the outer side of the second transport belt in a direction orthogonal to the transport direction of the web along the surface of the web and thereby, it is possible to decrease the suction chamber in the second transport belt. Therefore, it is possible to decrease the length of the second transport belt and thus, it is possible to decrease the apparatus in size.

(2) In the sheet manufacturing apparatus according to the aspect of the invention, a plurality of holes may be provided on a surface of the second transport unit which faces the first transport belt. The holes on a side closer to the suction unit may have a smaller ratio of opening of the holes per unit area on the surface than that of the holes on a side farther from the suction unit.

In the sheet manufacturing apparatus, the plurality of holes are provided on the surface of the second transport unit which faces the first transport belt, the holes on the side closer to the suction unit may have a smaller ratio of opening of the holes per unit area on the surface than that of the holes on the side farther from the suction unit. Thus, even when the suction unit is provided on the outer side of the second transport belt, it is possible to achieve a uniform suction force on the side closer to the suction unit and on the side farther from the suction unit.

(3) In the sheet manufacturing apparatus according to the aspect of the invention, the hole on the side closer to the suction unit may be smaller in size than the hole on the side farther from the suction unit.

In the sheet manufacturing apparatus, the holes on the side closer to the suction unit and on the side farther from the suction unit are changed in size and thus, it is possible to easily change the ratios of the opening of the holes per unit area on the side closer to the suction unit and on the side farther from the suction unit and it is possible to have a uniform suction force on the side closer to the suction unit and on the side farther from the suction unit.

(4) In the sheet manufacturing apparatus according to the aspect of the invention, the holes on the side closer to the suction unit may have a greater center-to-center distance of the holes adjacent to each other in the direction orthogonal to the transport direction of the web along the surface of the web than the holes on the side farther from the suction unit.

In the sheet manufacturing apparatus, the center-to-center distances of the adjacent holes on the side closer to the suction unit and on the side farther from the suction unit can be changed from each other and thus, it is possible to easily change the ratio of the opening of the holes per unit area on the side closer to the suction unit and on the side farther from the suction unit and it is possible to achieve a uniform suction force on the side closer to the suction unit and on the side farther from the suction unit.

(5) In the sheet manufacturing apparatus according to the aspect of the invention, the plurality of holes may be a plurality of holes provided in a current plate disposed in the suction chamber.

(6) In the sheet manufacturing apparatus according to the aspect of the invention, the plurality of holes may be a plurality of holes disposed in the second transport belt.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a preferred embodiment of the invention will be described with reference to the drawings. The details of the invention described in the claims are not inappropriately limited to the embodiments to be described below. In addition, the entire configurations to be described below are not the essential requirements of the invention.

1. Entire Configuration

Figure 1:
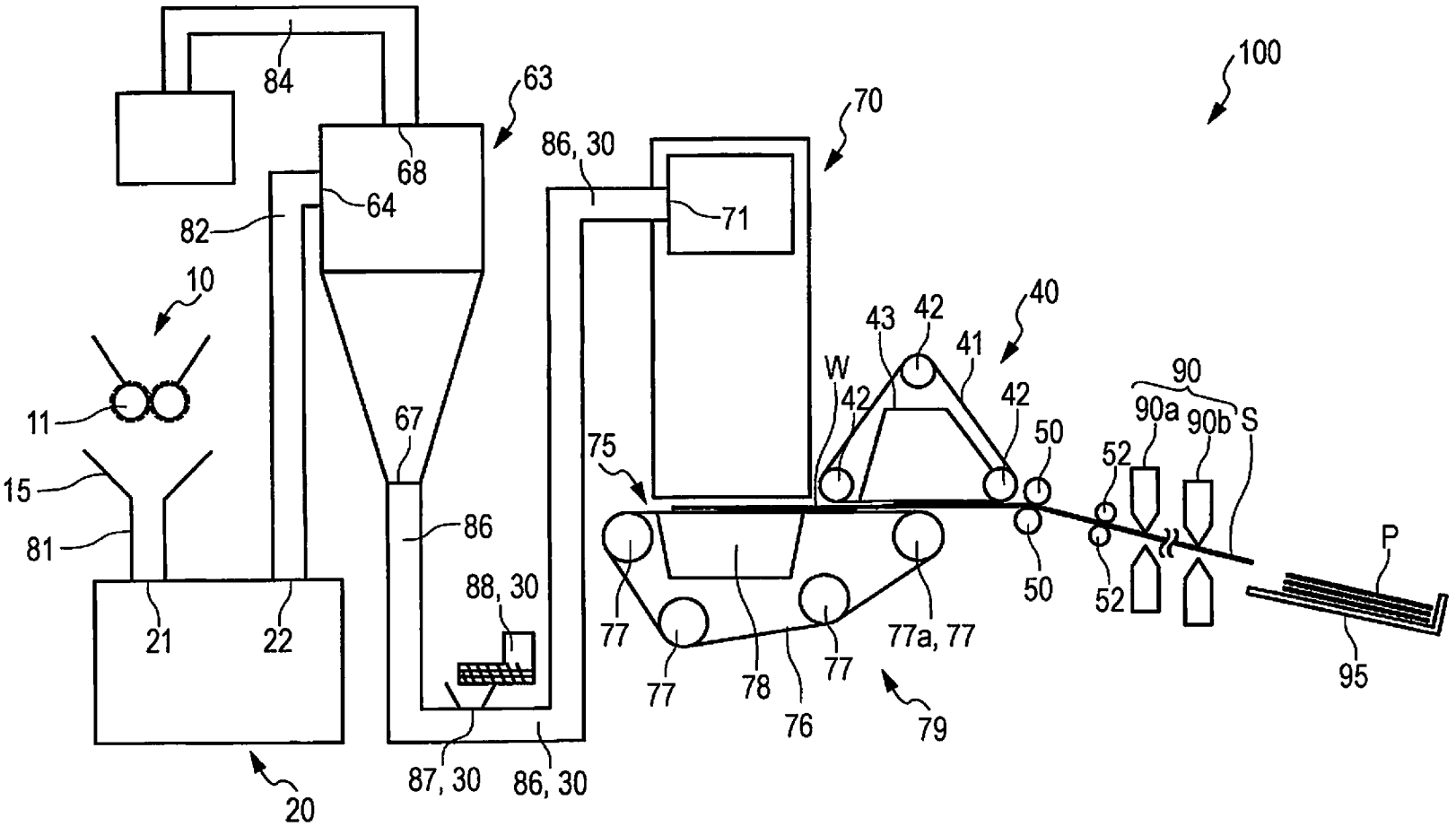
FIG. 1 is a view schematically illustrating a sheet manufacturing apparatus according to an embodiment.

FIG. 1 is a view schematically illustrating a sheet manufacturing apparatus 100 according to an embodiment. As illustrated in FIG. 1, the sheet manufacturing apparatus 100 includes a crushing unit 10, a defibrating unit 20, a classification unit 63, a mixing unit 30, a disentanglement unit 70, an accumulation unit 75, a first transport unit 79, a second transport unit 40, a pressurizing unit 50, a heating unit 52, and a cutting unit 90.

The crushing unit 10 cuts (crush), in the air, a raw material (source material) such as a pulp sheet or paper (for example, A4-size waste paper) put therein into strips. A shape or size of the strip is not particularly limited; however, the strip forms a quadrangle of several centimeters. In an example illustrated in the drawings, the crushing unit 10 has a crushing blade 11 and it is possible to cut the raw material put in by the crushing blade 11. The crushing unit 10 may be provided with an automatic put-in section (not illustrated) for continuously putting in the raw material.

The strip cut by the crushing unit 10 is received in a hopper 15 and then, is transported to the defibrating unit 20 via a pipe 81. The pipe 81 communicates with a guiding-in opening 21 of the defibrating unit 20.

The defibrating unit 20 defibrates the strip (defibration object). The defibrating unit 20 generates fibers fibrillated in a fiber shape through the defibrating process of the strip.

Here, the term "defibrating process" indicates the refining of the strip (defibration object) of a plurality of bonded fibers into individual fibers. The term "defibrated material" indicates the material that has passed through the defibrating unit 20. The term "defibrated material" also includes resin particles (resin for mutual bonding of a plurality of fibers) and ink particles of inks, toners, and blur-preventing agents when the fibers are refined, in addition to the refined fibers. In the following description, the "defibrated material" is at least a part of materials that passed through the defibrating unit 20 and may be mixed with a substance that is added after passing through the defibrating unit 20.

The defibrating unit 20 separates resin particles, or ink particles such as ink, toner, or a blur preventing material which are attached to the strip from the fiber. Along with the defibrated material, the resin particles and the ink particles are discharged from a discharge opening 22. The defibrating unit 20 performs the defibrating process on the strip guided in through the guiding-in opening 21 using a rotating blade. The defibrating unit 20 defibrates in a dry type system in the atmosphere (in air).

It is preferable that the defibrating unit 20 has a mechanism for producing an air current (airflow). In this case, the defibrating unit 20 generates an air current and uses the generated air current to draw in the defibration object from the guiding-in opening 21, defibrates, and transfers the defibrated material to the discharge opening 22. The defibrated material discharged from the discharge opening 22 is guided into the classification unit 63 via a pipe 82. In a case where the defibrating unit 20 which does not have an air current generating mechanism is used, a mechanism that generates an air current for introducing the strip to the guiding-in opening 21 may be provided externally.

The classification unit 63 separates and removes the resin particles and the ink particles from the defibrated material. As the classification unit 63, an air current type classifier is used. The air current type classifier produces a swirling air current and performs separation by a centrifugal force and a size or density of a substance to be classified such that it is possible to adjust a classification point by adjusting a speed or centrifugal force of the air current. Specifically, a cyclone, an Elbow-jet, an eddy classifier, or the like is used as the classification unit 63. Particularly, since the cyclone has a simple structure, it is possible for the cyclone to be appropriately used as the classification unit 63. Hereinafter, a case of using the cyclone as the classification unit 63 will be described.

The classification unit 63 has at least a guiding-in opening 64, a lower discharge opening 67 provided in the lower portion, and an upper discharge opening 68 provided in the upper portion. In the classification unit 63, an air current containing the defibrated material guided in from the guiding-in opening 64 is caused to move in a circling motion and thereby, the centrifugal force is applied to the defibrated material guided in such that the fiber material (fibrillated fiber) is separated from waste (resin particles and ink particles) which is lower in density than the fiber material. The fiber material is discharged from the lower discharge opening 67 and is guided into a guiding-in opening 71 of the disentanglement unit 70 through a pipe 86. The waste is discharged to the outside of the classification unit 63 from the upper discharge opening 68 through a pipe 84.

It is described that the fiber material is separated from the waste by the classification unit 63; however, the separation is not performed with accuracy. In some cases, a relatively small fiber material or a fiber material with low density is discharged to the outside along with the waste. In addition, in some cases, waste with relatively high density or waste entangled with the fiber material is guided into the disentanglement unit 70 along with the fiber material. In this application, a substance discharged from the lower discharge opening 67 (substance having a higher ratio of long fibers than waste) is referred to as the "fiber material". A substance discharged from the upper discharge opening 68 (substance having a lower ratio of long fibers than a fiber material) is referred to as the "waste". In a case where the raw material is not waste paper but a pulp sheet, since no substance corresponding to waste is contained, the classification unit 63 may be omitted from the configuration of the sheet manufacturing apparatus 100.

A supply opening 87 for supplying a resin which binds the fibers to each other is provided in the pipe 86. A resin supplying unit 88 supplies the resin in the air into the pipe 86 from the supply opening 87. That is, the resin supplying unit 88 supplies the resin on a path of the fiber material from the classification unit 63 toward the disentanglement unit 70. There is no particular limitation to the resin supplying unit 88 as long as the resin is supplied into the pipe 86; however, a screw feeder, a circle feeder, or the like is used as the resin supplying unit 88. The resin supplied from the resin supplying unit 88 is a resin for binding the plurality of fibers. At a point in time when the resin is supplied into the pipe 86, the plurality of fibers are in a state of not being bound to one another. The resin is a thermoplastic resin or a thermoset resin, may have a fiber shape, or may be powdery. An amount of the resin supplied from the resin supplying unit 88 is appropriately set depending on a type of sheet to be manufactured. In addition to the resin for binding the fibers, the resin supplying unit 88 may supply a colorant for coloring the fiber or an aggregation inhibitor for inhibiting aggregation of the fibers depending on a type of sheet to be manufactured. The resin supplying unit 88 may be omitted from the configuration of the sheet manufacturing apparatus 100.

The resin supplied from the resin supplying unit 88 is mixed with the fiber material which is classified by the classification unit 63, by the mixing unit 30 provided in the pipe 86. The mixing unit 30 mixes the fiber material and the resin and performs the transport thereof to the disentanglement unit 70.

The disentanglement unit 70 disentangles the fiber material which is entangled. Further, the disentanglement unit 70 disentangles the entangled resin in a case where the resin supplied from the resin supplying unit 88 has the fiber shape. In addition, the disentanglement unit 70 accumulates the fiber material or the resin uniformly in the accumulation unit 75 to be described below. That is, the word, "disentangle", means both an action of disentangling the entangled substance into pieces and an action of a uniform accumulation. When there is no entangled substance, the disentanglement unit 70 performs the action of the uniform accumulation. A sieve is used as the disentanglement unit 70. The disentanglement unit 70 is a rotating sieve in which a net section rotates by a motor (not illustrated). Here, the "sieve" used as the disentanglement unit 70 may not have a function of selecting a specific target object. This means that the "sieve" used as the disentanglement unit 70 has the net section with a plurality of openings and the disentanglement unit 70 may discharge the entire fiber material and resin guided into the disentanglement unit 70 to the outside from the openings. The disentanglement unit 70 may be omitted from the configuration of the sheet manufacturing apparatus 100.

In a state in which the disentanglement unit 70 rotates, the mixture of the fiber material and the resin is guided into the inside the disentanglement unit 70 formed of a cylindrical net section from the guiding-in opening 71. The mixture guided into the disentanglement unit 70 travels to the side of the net section by the centrifugal force. As described above, in some cases, the mixture guided into the disentanglement unit 70 contains the entangled fiber or resin and then, the entangled fiber or resin are disentangled in the air through the rotating net section. Then, the disentangled fiber or resin passes through the openings.

The fiber material and resin which passed through the opening of the disentanglement unit 70 are accumulated in the accumulation unit 75. The accumulation unit 75 is positioned under the disentanglement unit 70 and causes the fiber material and resin which passed through the opening of the disentanglement unit 70 to be accumulated on a first transport belt 76 such that a web W (accumulated material) is formed.

The first transport unit 79 has the first transport belt 76 and a stretching roller 77 and transports the web W. The first transport belt 76 stretched by the stretching roller 77 is an endless mesh belt in which a mesh is formed. The first transport belt 76 travels (circles around) by the rotation of the stretching roller 77. The fiber material and the resin are continuously dropped and accumulated from the disentanglement unit 70 while the first transport belt 76 continuously travels and thereby, the web W having a uniform thickness is formed on the first transport belt 76.

A suction device 78 that sucks the accumulated material downward is provided below the disentanglement unit 70 interposing the first transport belt 76 (the accumulation unit 75) therebetween. The suction device 78 produces an air current (air current which travels toward the accumulation unit 75 from the disentanglement unit 70) which is directed vertically downward. In this way, it is possible to suck in the fiber material and the resin dispersed in the air and thus, to increase a discharge speed from the disentanglement unit 70. As a result, it is possible to increase productivity of the sheet manufacturing apparatus 100. In addition, it is possible to form a downflow in a dropping path of the fiber material and the resin by the suction device 78 and thus, to prevent the fiber materials or the resins from entangling with each other during the dropping.

The second transport unit 40 transports, toward the pressurizing unit 50, the web W that is formed on the first transport belt 76 and is transported by the first transport unit 79. In addition, the second transport unit 40 transports the web W while sucking the web W vertically upward (a direction in which the web W is separated from the first transport belt 76). In addition, the second transport unit 40 is disposed to be spaced from the first transport unit 79 (the first transport belt 76) vertically upward (a direction perpendicular to the surface of the web W) and is disposed with a part thereof shifted on the downstream side from the first transport unit 79 (the first transport belt 76) in the transport direction of the web W. A transport zone of the second transport unit 40 becomes a zone from a stretching roller 77*a* on the downstream side of the first transport unit 79 to the pressurizing unit 50.

Figure 2:
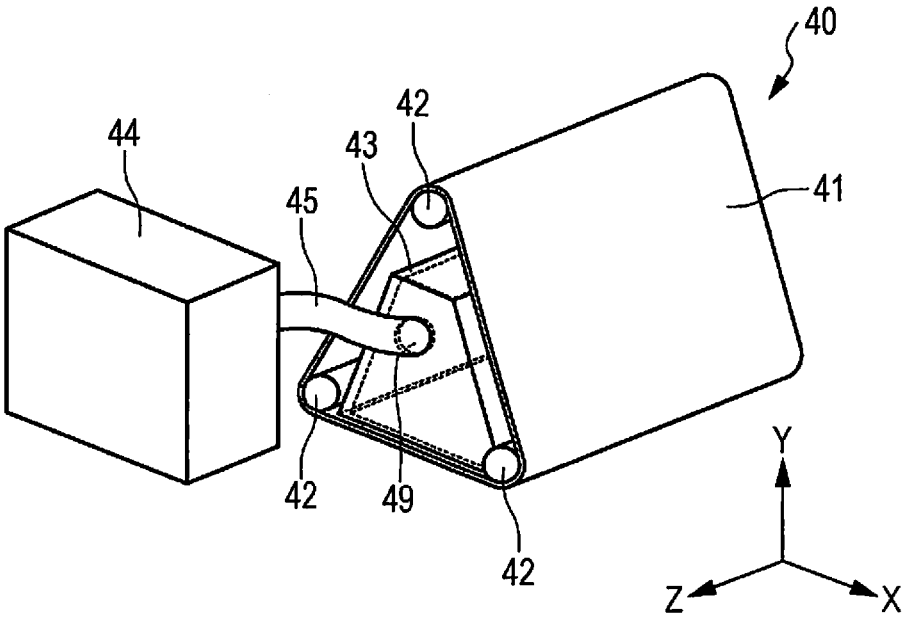
FIG. 2 is a perspective view schematically illustrating a second transport unit.

The second transport unit 40 includes a second transport belt 41, a stretching roller 42, a suction chamber 43, and a suction unit (refer to FIG. 2). The second transport belt 41 stretched by a stretching roller 42 is an endless mesh belt in which a mesh is formed.

The suction chamber 43 is positioned on the inner side of the second transport belt 41 and the inner space of the suction chamber 43 is sucked by the suction unit that produces the air current (suction force) such that the web W is adsorbed onto the second transport belt 41. That is, the suction unit and the suction chamber 43 produce the air current directed vertically upward from the first transport belt 76, thereby sucking the web W upward, and adsorb the web W onto the second transport belt 41. The second transport belt 41 travels (circles around) by the rotation of the stretching roller 42 and transports the web W. The stretching roller 42 rotates such that the second transport belt 41 travels at the same speed as that of the first transport belt 76. When there is a difference between the speeds of the first transport belt 76 and the second transport belt 41, the web W is stretched to end up breaking or buckling, which may be prevented at the same speed.

A part of the suction chamber 43 is overlapped with the first transport belt 76 when viewed upward and, since the suction chamber 43 is disposed at a position on the downstream side which is not overlapped with the suction device 78, the web W on the first transport belt 76 is peeled off from the first transport belt 76 at a position facing the suction chamber 43 and is adsorbed onto the second transport belt 41.

The pressurizing unit 50 is configured of a pair of pressurizing rollers and the web W transported by the second transport unit 40 is nipped between the rollers and is pressurized. The heating unit 52 is disposed on the downstream side of the pressurizing unit 50, is configured of a pair of heating rollers, and heats and pressurizes the web W by nipping the web W between the rollers. The web W which is the accumulated material formed by accumulation of the fiber material and the resin is heated and pressurized by passing through the pressurizing unit 50 and the heating unit 52. The heating causes the resin to function as a binding agent so as to bind the fibers to each other and, by the pressurizing, a sheet P is shaped to be thin and to have a smooth surface.

As the cutting unit 90 that cuts the sheet P, a first cutting section 90*a* that cuts the sheet P in a direction intersecting with a transport direction of the sheet P and a second cutting section 90*b* that cuts the sheet P along the transport direction of the sheet P are disposed on the downstream side of the heating unit 52. The first cutting section 90*a* has a cutter and cuts the long-continuous sheet P to a sheet shape in accordance with cutting positions set to have a predetermined length therebetween. The second cutting section 90*b* has a cutter and cuts the sheet P to a sheet shape in accordance with a predetermined cutting positions in the transport direction of the sheet P. In this way, a sheet with a desired size is formed. The cut sheets P are loaded in a stacker 95 or the like. A configuration may be employed, in which the sheet P is not cut, but is rolled by a winding roller in a continuous shape. As above, it is possible to manufacture the sheet P.

2. Configuration of Second Transport Unit

FIG. 2 is a perspective view schematically illustrating the second transport unit 40. As illustrated in FIG. 2, the suction chamber 43 disposed on the inner side of the second transport belt 41 has a hollow of a box shape which has a top surface and four side surfaces that are in contact with the top surface and the bottom (facing a lower surface of the second transport belt 41) is opened.

The two side surfaces of the four side surfaces of the suction chamber 43 face the second transport belt 41. An opening 49 that communicates with a pipe 45 is provided on at least one of the two side surfaces which do not face the second transport belt 41. The suction unit 44 (blower) and the suction chamber 43 are connected to each other via the pipe 45. The air inside the suction chamber 43 is sucked to the suction unit 44 via the pipe 45 and the air flows in from the bottom of the suction chamber 43. In this way, an air current directed upward (a +Y axial direction in FIG. 2) is produced and it is possible to suck the web W upward (the web W is adsorbed onto the second transport belt 41). In an example illustrated in FIG. 2, since ends of a part of the side surfaces of the suction chamber 43 are in contact with the stretching rollers 42, a brush-like sealing material is provided at the ends. In this way, the air is suppressed not to flow in from a gap between the ends and the stretching rollers 42. In addition, in this way, it is possible to lengthen a zone in which the suction is performed, in the transport direction of the web W.

In the second transport unit 40 of the embodiment, the suction unit 44 is not disposed on the inner side of the second transport belt 41, but the suction unit 44 is provided on the outer side of the second transport belt 41 in a direction (a +Z axial direction in an example illustrated in FIG. 2) orthogonal to the transport direction of the web W (a +X axial direction in FIG. 2) along the surface of the web W. That is, the suction is not performed from the top surface of the suction chamber 43 but a configuration is employed, in which the suction is performed from side surfaces of the suction chamber 43 which do not face the second transport belt 41. In this way, since it is possible to reduce a space surrounded by the second transport belt 41, it is possible to reduce the length of the second transport belt 41 and to decrease the apparatus in size.

When the suction unit 44 is disposed on the outer side of the second transport belt 41 and is configured to perform the suction from the side surfaces of the suction chamber 43, the suction force is not uniform on the side closer to and on the side farther from the suction unit 44 (opening 49). That is, in a width direction of the second transport belt 41, the suction force becomes weaker on the side farther from the suction unit 44 than on the side closer to the suction unit 44.

Figure 3:
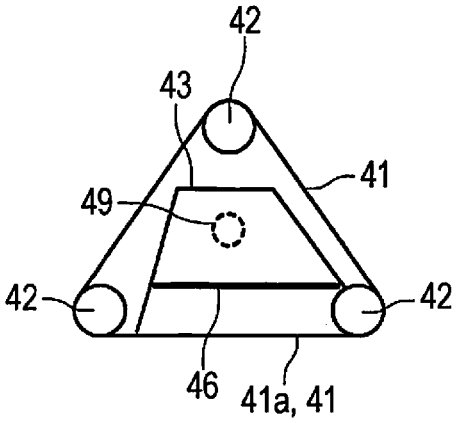
FIG. 3 is a view schematically illustrating the second transport unit.

As illustrated in FIG. 3, the current plate 46 is provided in the suction chamber 43 and thereby, the suction force may be caused to be uniform in the width direction of the second transport belt 41. The current plate 46 is plate-like having a plurality of holes on the surface thereof, and is disposed at a position between the lower transport surface 41*a* (surface of the second transport unit 40 on which the web W is sucked and transported) of the second transport belt 41 and the opening 49 in the suction chamber 43 so as for the surface having the holes to be substantially parallel to the transport surface 41*a* of the second transport belt 41. In addition, ends of the current plate 46 are in contact with the side surfaces of the suction chamber 43. In addition, on the surface of the current plate 46, the ratio of the opening (hole) per unit area is smaller on the side closer to the suction unit 44 than on the side farther from the suction unit 44.

Figure 4A:
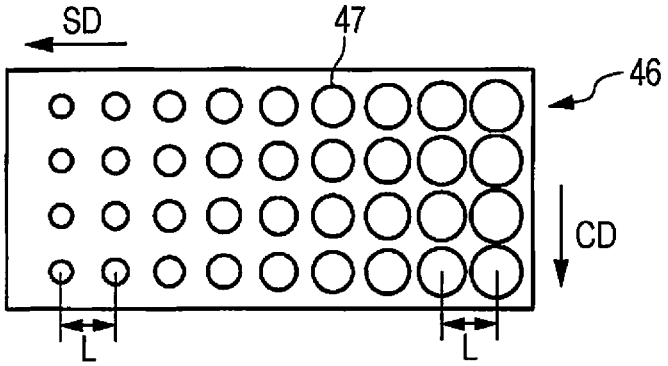
FIGS. 4A to 4D are views schematically illustrating examples of a current plate.
Figure 4B:
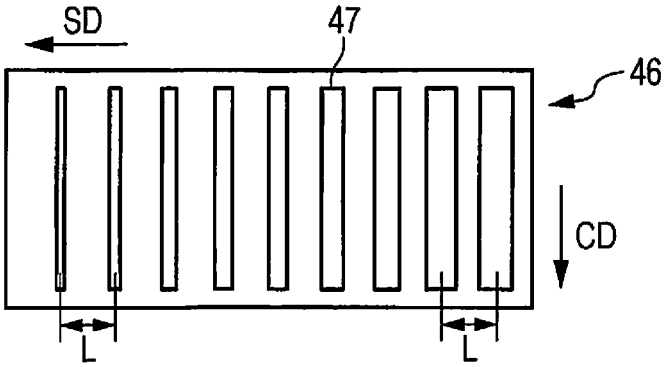
Figure 4C:
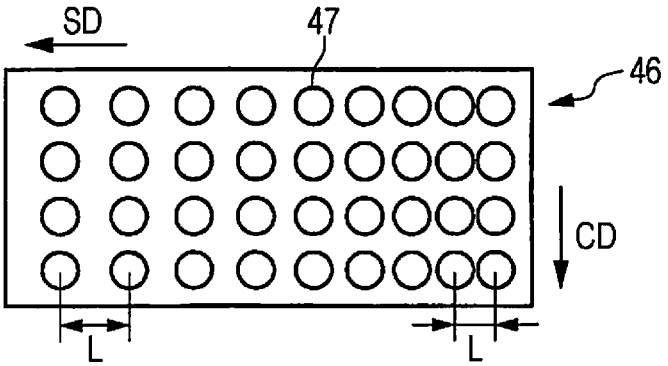
Figure 4D:
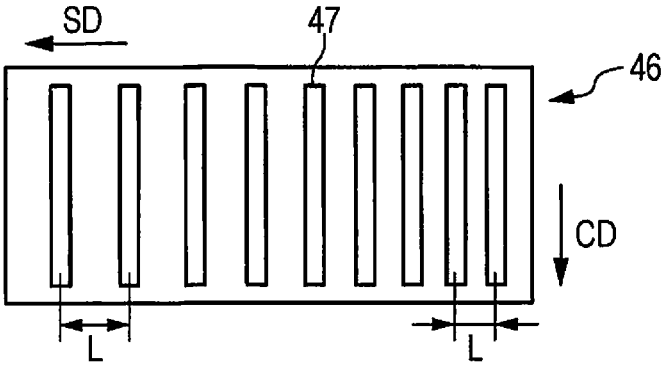

FIGS. 4A to 4D are views schematically illustrating examples of the current plate 46. FIG. 4A and FIG. 4C illustrate examples of the current plate 46 in which the round holes 47 are provided and FIG. 4B and FIG. 4D illustrate examples of the current plate 46 in which the rectangular (slit shaped) holes 47 are provided. In addition, FIG. 4A and FIG. 4B illustrate examples in which the size (diameter and width) of the hole 47 is adjusted such that a ratio of the opening per unit area is adjusted and FIG. 4C and FIG. 4D illustrate examples in which a pitch L of the hole 47 (center-to-center distance of the holes 47 adjacent to each other in a suction direction SD orthogonal to the transport direction CD) is adjusted such that a ratio of the opening per unit area is adjusted.

In the current plate 46 illustrated in FIG. 4A and FIG. 4B, the diameter and width of the holes 47 on the side closer to the suction unit 44 (side in the suction direction SD) is less than the diameter and width of the holes 47 on the side farther from the suction unit 44 and thereby, the ratio of the opening per unit area on the side closer to the suction unit 44 becomes low. In the current plate 46 illustrated in FIG. 4C and FIG. 4D, the pitch L of the holes 47 on the side closer to the suction unit 44 is greater than the pitch L of the holes 47 on the side farther from the suction unit 44 and thereby, the ratio of the opening per unit area on the side closer to the suction unit 44 becomes low. In an example illustrated in FIG. 4A and FIG. 4B, the pitch L of the holes 47 in a direction orthogonal to the transport direction CD of the web is constant and in an example illustrated in FIG. 4C and FIG. 4D, the size of the holes 47 is constant; however, in the current plate 46, both the pitch L of the holes 47 and the size of the holes 47 may be changed together.

As above, the current plate 46 is provided in the suction chamber 43 and on the surface of the current plate 46, the ratio of the opening per unit area is smaller on the side closer to the suction unit 44 (opening 49) than that on the side farther from the suction unit 44 and thereby, it is possible to achieve a uniform suction force on the side closer to the suction unit 44 and the side farther from the suction unit 44 even when the second transport unit 40 is configured to perform the suction from the side surfaces of the suction chamber 43 and it is possible to perform reliable suction (adsorption) of the web W over the width direction of the second transport belt 41.

It is preferable that the current plate 46 is disposed to be spaced from the transport surface 41*a* of the second transport belt by a certain distance. In a case where the current plate 46 is in contact with the transport surface 41*a* of the second transport belt, the suction force is unlikely to act on another region of the opening (holes 47) of the current plate 46. Therefore, a region in which strong adsorption of the web W is performed and a region in which adsorption of the web W is not performed are present and, in some cases, it is not possible to uniformly adsorb the web W. In a case where the current plate 46 is disposed to be spaced from the transport surface 41*a* of the second transport belt, an air current is diffused between the current plate 46 and the transport surface 41*a* of the second transport belt. Therefore, the suction force also acts on at the region other than the opening of the current plate 46 and it is possible to uniformly adsorb the web W.

Figure 5A:
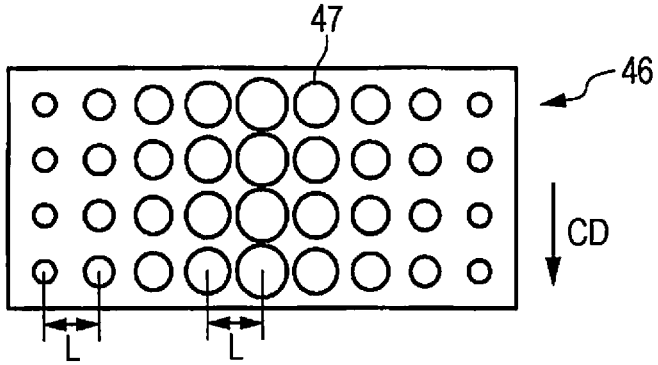
FIGS. 5A and 5B are views schematically illustrating examples of a current plate.
Figure 5B:
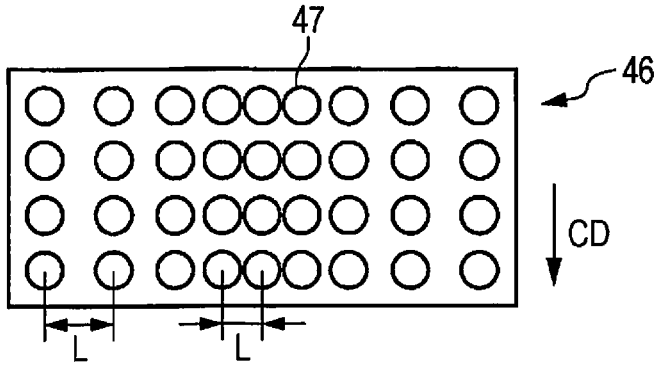

In addition, in the examples above, a case is described, in which the suction is performed from one of two side surfaces of the suction chamber 43 which do not face the second transport belt 41; however, the openings 49 are provided on the two side surfaces which do not face the second transport belt 41, respectively, and the second transport unit 40 may be configured to perform the suction from both of the two side surfaces using two suction units 44 (or one suction unit 44). In this case, in the width direction of the second transport belt 41, the suction force becomes weaker on the center side compared to the end side. Accordingly, in a case where the suction is performed from both of the two side surfaces of the suction chamber 43, as illustrated in FIGS. 5A and 5B, in the current plate 46, when the ratio of the opening per unit area is lower on the end side (side closer to the suction unit 44) than on the center side (side father from the suction unit 44), it is possible to achieve the uniform suction force in the width direction of the second transport belt 41. In the current plate 46 illustrated in FIG. 5A, the diameter of the hole 47 on the end side is less than the diameter of the hole 47 on the center side, and in the current plate 46 illustrated in FIG. 5B, the pitch L of the hole 47 on the end side is greater than the pitch L of the hole 47 on the center side.

In addition, instead of providing the current plate 46 in the suction chamber 43, a mesh of the second transport belt 41 is configured to have a smaller ratio of the opening (opening formed on the mesh, an example of "hole" of the invention) per unit area on the side closer to the suction unit 44 than on the side farther from the suction unit 44 in a width direction (direction orthogonal to the transport direction) of the second transport belt 41 and thereby, the suction force may be uniform in the width direction of the second transport belt 41. For example, the mesh of the second transport belt 41 may be configured to have a smaller opening in size on the side closer to the suction unit 44 than on the side farther from the suction unit 44 in the width direction of the second transport belt 41, or to have a pitch (center-to-center distance of the adjacent openings) of the openings on the side closer to the suction unit 44 greater in size than the pitch of the opening on the side farther from the suction unit 44.

In addition, the shape of the hole 47 is not limited to the circle or the rectangle, but may be any shape as long as the suction can be performed. In the suction direction SD in FIG. 4A and FIG. 4B, the size of the holes 47 is gradually decreased; however, the configuration is not limited thereto, and the size of the holes 47 is the same by two rows in the suction direction SD and in this way, the size may be gradually changed. The holes 47 may have the same size not by two rows, but by three or more rows. Similarly, in FIG. 4C and FIG. 4D, the pitch L is gradually changed; and two or more rows of the holes have the same pitch and thereby, the size may gradually be changed. The ratio of the opening of the holes 47 per unit area corresponds to a ratio of an area of the opening of the holes 47 in an area of a divided region when a space between the hole 47 and the hole 47 is divided at the center along the suction direction SD. In FIG. 4A and FIG. 4B, the pitch L is constant. Thus, when the space between the hole 47 and the hole 47 is divided at the center, the divided area is constant in the suction direction SD. Since the holes 47 are gradually decreased in size in the suction direction SD, the ratio of the holes 47 per unit area is also gradually decreased. In FIG. 4C and FIG. 4D, the pitch L is gradually increased. Thus, when the space between the hole 47 and the hole 47 is divided at the center, the area of the divided region is gradually increased in the suction direction SD. However, since the area of the hole 47 is the same, the ratio of the holes 47 per unit area is gradually decreased.

3. Modification Example

The invention includes practically the same configuration (configuration having the same function, method, and effect or configuration having the same object and effect) as the configuration described in the embodiments. In addition, the invention contains a configuration in which a non-essential part of the configuration described in the embodiments is substituted. In addition, the invention includes a configuration which achieve the same operation effects as the configuration described in the embodiments or a configuration in which it is possible to achieve the same object. In addition, the invention includes a configuration obtained by applying a known technology to the configuration described in the embodiments.

A sheet manufactured by the sheet manufacturing apparatus 100 mainly indicates a sheet-shaped one. However, the sheet is not limited to the sheet-shaped one, but may be board-shaped or web-shaped. The sheet in this specification is divided into paper and nonwoven fabric: The paper includes an aspect or the like in which pulp or waste paper as a raw material is formed into a thin sheet shape and includes recording paper used for writing or printing, wallpaper, wrapping paper, colored paper, drawing paper, Kent paper, or the like. The nonwoven fabric is thicker one or one having lower strength than the paper and includes common nonwoven fabric, fiberboard, tissue paper, kitchen paper, a cleaner, a filter, a liquid absorber, a sound absorber, a cushioning material, a mat or the like. Examples of the raw material may include a plant fiber such as cellulose, a chemical fiber such as polyethylene terephthalate (PET) or polyester, or an animal fiber such as wool or silk.

In addition, a moisture sprayer for adding moisture by spraying to the accumulated material accumulated in the accumulation unit 75 may be provided. In this way, it is possible to achieve high strength of a hydrogen bond when the sheet P is shaped. The moisture is added by spraying to the accumulated material before passing through the heating unit 52. Starch, polyvinyl alcohol (PVA) or the like may be added to water moisture which is sprayed by the moisture sprayer. In this way, it is possible to increase strength of the sheet P.

The crushing unit 10 may not be provided in the sheet manufacturing apparatus 100. For example, when the raw material is obtained by being crushed by an existing shredder or the like, there is no need to use the crushing unit 10.

In addition, in the above embodiments, a case where the invention is applied to a dry-type sheet manufacturing apparatus; however, the invention may be applied to a wet-type sheet manufacturing apparatus.

The entire disclosure of Japanese Patent Application No. 2014-044765, filed Mar. 7, 2014 is expressly incorporated by reference herein.

What is claimed is:

1. A sheet manufacturing apparatus that forms a sheet using a web, the apparatus comprising:

an accumulation unit that accumulates the web containing at least a fiber on a first transport belt;

a first transport unit that causes the first transport belt to circle around so as to transport the web; and a second transport unit that is spaced from the first transport unit in a direction perpendicular to a surface of the web, is disposed with a part thereof shifted from the first transport unit toward a downstream side in a transport direction of the web, and sucks the web in a direction in which the web is spaced from the first transport belt and transports the web, the second transport unit including a suction unit that generates a suction force, a second transport belt that circles around, and a suction chamber which is positioned in an inner side of the second transport belt circling around and of which an inner space is sucked by the suction unit, the suction unit creating suction inside the suction chamber to suck the web onto the second transport belt, the second transport unit having a surface which faces toward the first transport belt and having a plurality of holes arranged on the surface such that each of the holes penetrates from the surface to the inner space in a perpendicular direction orthogonal to the transport direction of the web, the suction unit being positioned on an outer side of the second transport belt in a suction direction that is orthogonal to the perpendicular direction and that is orthogonal to the transport direction of the web along the surface of the web, a plurality of pairs of adjacent holes of the holes being arranged on the surface, the adjacent holes being arranged in the suction direction, a first pair of the adjacent holes having a first center-to-center distance in the suction direction between the first pair, a second pair of the adjacent holes having a second center-to-center distance in the suction direction between the second pair, the first pair being positioned closest to the suction unit among the plurality of the pairs, the second pair being positioned farthest from the suction unit among the plurality of the pairs, the first center-to-center distance being greater than the second center-to-center distance.

2. The sheet manufacturing apparatus according to claim 1, wherein the holes on a side closer to the suction unit have a smaller ratio of opening of the holes per unit area on the surface than that of the holes on a side farther from the suction unit.

3. The sheet manufacturing apparatus according to claim 2, wherein the plurality of holes are a plurality of holes provided in a current plate disposed in the suction chamber.

4. The sheet manufacturing apparatus according to claim 2, wherein the plurality of holes are a plurality of holes disposed in the second transport belt.

5. The sheet manufacturing apparatus according to claim 1, wherein the suction chamber includes a plurality of walls defining the inner space, and the walls has two side walls that are arranged opposite to each other in the direction orthogonal to the transport direction along the surface of the web, and at least one of the two side walls has an opening portion that communicates with the suction unit.

6. A sheet manufacturing apparatus that forms a sheet using a web, the apparatus comprising:

an accumulation unit that accumulates the web containing at least a fiber on a first transport belt;

a first transport unit that causes the first transport belt to circle around so as to transport the web; and a second transport unit that is spaced from the first transport unit in a perpendicular direction, is disposed with a part thereof shifted from the first transport unit toward a downstream side in a transport direction of the web, and sucks the web in a direction in which the web is spaced from the first transport belt and transports the web, the perpendicular direction being perpendicular to the transport direction, the second transport unit including a suction unit that generates a suction force, a second transport belt that circles around, and a suction chamber which is positioned in an inner side of the second transport belt circling around and of which an inner space is sucked by the suction unit, the suction unit creating suction inside the suction chamber to suck the web onto the second transport belt, and the second transport unit having a surface which faces toward the first transport belt and having a plurality of holes arranged on the surface such that each of the holes penetrates from the surface to the inner space in the perpendicular direction, the suction unit being positioned on an outer side of the second transport belt and arranged, relative to the second transport belt, in a suction direction that is orthogonal to the transport direction of the web and that is orthogonal to the perpendicular direction, a plurality of pairs of adjacent holes of the holes being arranged on the surface, the adjacent holes being arranged in the suction direction, a first pair of the adjacent holes having a first center-to-center distance in the suction direction between the first pair, a second pair of the adjacent holes having a second center-to-center distance in the suction direction between the second pair, the first pair being positioned closest to the suction unit among the plurality of the pairs, the second pair being positioned farthest from the suction unit among the plurality of the pairs, the first center-to-center distance being greater than the second center-to-center distance.

7. The sheet manufacturing apparatus according to claim 6, wherein the suction chamber includes a plurality of walls defining the inner space, and the walls has two side walls that are arranged opposite to each other in the direction orthogonal to the transport direction and the perpendicular direction, and at least one of the two side walls has an opening portion that communicates with the suction unit.

8. A sheet manufacturing apparatus that forms a sheet using a web, the apparatus comprising:

an accumulation unit that accumulates the web containing at least a fiber on a first transport belt;

a first transport unit that causes the first transport belt to circle around so as to transport the web; and a second transport unit that is spaced from the first transport unit in a direction perpendicular to a surface of the web, is disposed with a part thereof shifted from the first transport unit toward a downstream side in a transport direction of the web, and sucks the web in a direction in which the web is spaced from the first transport belt and transports the web, the second transport unit including a suction unit that generates a suction force, a second transport belt that circles around, and a suction chamber which is positioned in an inner side of the second transport belt circling around and of which an inner space is sucked by the suction unit, the suction unit creating suction inside the suction chamber to suck the web onto the second transport belt, the second transport unit having a surface which faces toward the first transport belt and having a plurality of holes arranged on the surface such that each of the holes penetrates from the surface to the inner space in a perpendicular direction orthogonal to the transport direction of the web, the suction unit being positioned on an outer side of the second transport belt in a suction direction that is orthogonal to the perpendicular direction and that is orthogonal to the transport direction of the web and parallel to the surface of the web, a plurality of pairs of adjacent holes of the holes being arranged on the surface, the adjacent holes being arranged in the suction direction, a first pair of the adjacent holes having a first center-to-center distance in the suction direction between the first pair, a second pair of the adjacent holes having a second center-to-center distance in the suction direction between the second pair, the first pair being positioned closest to the suction unit among the plurality of the pairs, the second pair being positioned farthest from the suction unit among the plurality of the pairs, the first center-to-center distance being greater than the second center-to-center distance.

* * * * *